United States Patent [19]

Boggs et al.

[11] 4,078,949

[45] Mar. 14, 1978

[54] METHOD FOR IMPROVING THE SURFACE QUALITY OF STAINLESS STEELS AND OTHER CHROMIUM-BEARING IRON ALLOYS

[75] Inventors: William E. Boggs, Franklin Township, Westmoreland County; Daniel E. Sonon, Penn Hills Township, Allegheny County, both of Pa.

[73] Assignee: United States Steel Corporation, Pittsburgh, Pa.

[21] Appl. No.: 719,750

[22] Filed: Sep. 2, 1976

[51] Int. Cl.[2] ..... C23F 7/04

[52] U.S. Cl. ..... 148/6.35; 134/3; 134/41; 148/136

[58] Field of Search ..... 148/135, 136, 6.35, 148/6.3; 134/3, 41; 156/664, 667

[56] References Cited

U.S. PATENT DOCUMENTS

| | | | |
|---|---|---|---|
| 1,932,560 | 10/1933 | Payne | 148/6.35 |
| 3,377,213 | 4/1968 | Hiller | 148/6.35 |

OTHER PUBLICATIONS

McCullough et al., "Formation of Oxides on Some Stainless Steels at High Temperatures", 1950.

Hickman et al., "An Electron Diffraction Study of Oxide Films Formed on High Temperature Oxidation Resistant Alloys", 1947.

*Primary Examiner*—Ralph S. Kendall

*Attorney, Agent, or Firm*—Forest C. Sexton

[57] ABSTRACT

A method of surface conditioning a stainless steel to remove oxides and imperfections therefrom whereby the steel is heated in a controlled atmosphere having an oxygen potential, (log $P_{O_2}$) between $(-29{,}280/T) + 5.6$ and $(-27{,}840/T) + 8.1$ where T is the absolute temperature in degrees Kelvin.

17 Claims, 3 Drawing Figures

AS-MACHINED

45 MIN.
10:1

45 MIN.
6.5:1

90 MIN.
10:1

90 MIN.
6.5:1

180 MIN.
10:1

180 MIN.
6.5:1

METHOD FOR IMPROVING THE SURFACE QUALITY OF STAINLESS STEELS AND OTHER CHROMIUM-BEARING IRON ALLOYS

This invention relates generally to the surface treating of stainless steels, and more particularly to a process for annealing or otherwise heat treating stainless steels or other chromium bearing steels to produce a surface oxide which can easily be removed to facilitate further processing.

It is well known that stainless steels get their corrosion resistance from a transparently thin, tight adhering oxide film, which is readily formed on the steel surface, even under conditions normally reducing to carbon steel. Although this oxide film is very beneficial on the finished stainless steel product, it does complicate the processing of stainless steels in the mill. This is because the oxide film is so tightly adhering that the descaling or pickling of stainless steels is very difficult as compared to the more conventional steels. To achieve efficient and thorough surface oxide removal from stainless steels, various, more severe processing techniques must be used which increase processing time and costs, and sometimes deteriorate the quality of the steel under the oxide because of the increased abrasive or chemical attack of the particular technique employed. For example, whereas carbon and low alloy steels can readily be pickled in dilute $H_2SO_4$ solutions, stainless steels must be pickled electrolytically in $H_2SO_4$ and then pickled in the more corrosive $HNO_3$—HF. In addition to being more expensive, pickling solutions containing HF are harmful pollutants. Whereas slabs, billets, bars, etc., of carbon and low alloy steels can readily be scaled, i.e. surface oxidized to remove slivers, scabs and other surface defects in preparation for further rolling, stainless steels must be ground, or grit blasted to remove slivers, scabs, etc. Many of these processing techniques for stainless steel must be done at slower rates than desired in order to assure complete removal of the oxide.

This invention is predicated upon our development of a heat treatment or annealing treatment for stainless steels or other chromium bearing steels which will cause the formation of a deep oxide on the surface of such steels which can easily be removed to thereby overcome the above described disadvantages.

Accordingly, it is an object of this invention to provide a process for heat treating stainless steels and other chromium bearing steels which causes the formation of an oxide on the surface thereof which can be removed more easily than conventionally formed oxides.

Another object of this invention is to provide a process for annealing a finished or semifinished stainless steel under conditions which will provide an oxide on the surface of the steel which can readily be removed by pickling in conventional acid solutions to provide a relatively smooth dull surface.

A further object of this invention is to provide a process for annealing a semifinished stainless steel slab, billet, rod, etc., under conditions which will provide more oxidation in a given annealing time and will therefore readily oxidize slivers, scabs and other surface defects from the steel, thereby permitting such defects to be readily removed during conventional pickling.

Still another object of this invention is to provide a process for annealing and pickling a finished stainless steel product to produce a smooth non-glare surface.

These and other objects and advantages are fulfilled by this invention as will become apparent from the following detailed description and attached drawings, of which:

As noted above, it is well known that stainless steels will preferentially oxidize under most conditions to form a thin, tightly-adhering $Cr_2O_3$ surface film. Once formed, the thin transparent oxide film provides a protective barrier which minimizes further oxidation or corrosion. The oxide film is quickly and readily formed under practically any conditions. That is to say, chromium's attraction for oxygen to form $Cr_2O_3$ is so strong many atmospheres which are strongly reducing to carbon steel and other alloy steels, are in fact oxidizing to the chromium in stainless steels. Indeed it is very difficult to achieve commercially practicable atmospheres which are reducing to $Cr_2O_3$, at least within normal heat treating temperature ranges.

The crux of this invention is based on our discovery that if the oxygen potential of an annealing atmosphere is carefully controlled within critical limits during the annealing or other heat treatment of a chromoum-containing stainless steel, the usual tightly adhering surface oxide gives-way to an iron-chromium spinel ($FeCr_2O_3$) which does not act as much of a barrier as does $Cr_2O_3$ to minimize further oxidation and is much more easily removed. The spinel form is easily distinguishable because it is black and magnetic, in contrast to the other chromium and iron-chromium oxides. Because the spinel is much less of a barrier than is $Cr_2O_3$ to further oxidation, it is possible to easily effect a deeper penetrating oxidation that is sufficient to remove slivers, scabs and other surface defects. In addition, the process of this invention has a tendency to oxidize surface peaks at a greater rate so that it will smoothen coarse, rough surfaces to provide a flat dull finish beneath the spinel.

Figure 1:
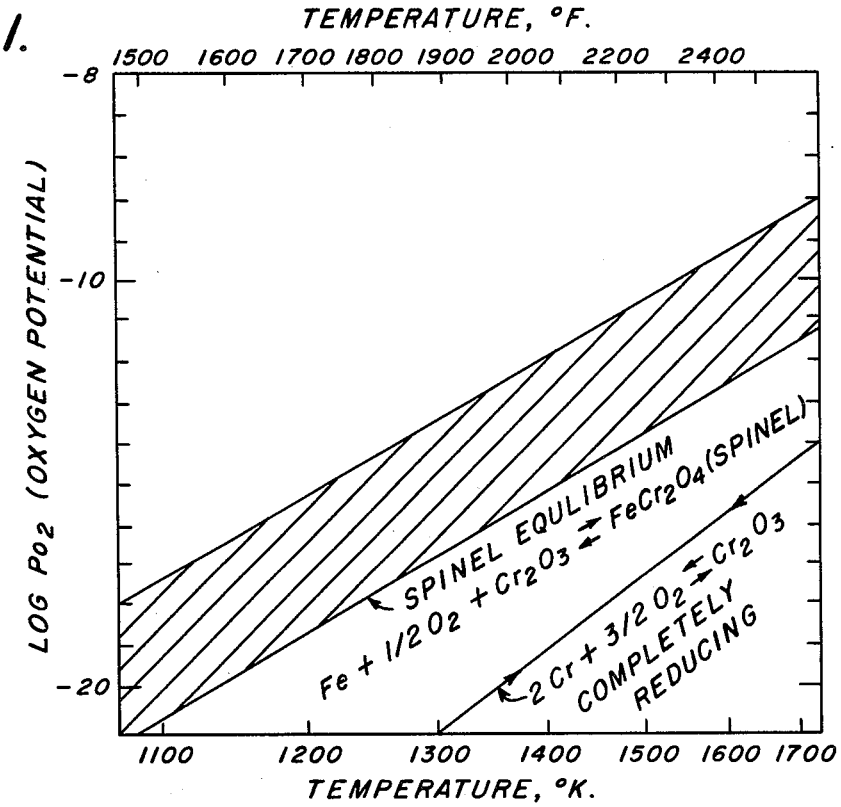
FIG. 1 is a graph showing the critical range of oxygen potentials with respect to temperature, as must be employed in the annealing atmosphere in the process of this invention.

Reference to FIG. 1 will illustrate the critical range of oxygen potentials with respect to temperature. Broadly speaking, the process of this invention requires that a stainless steel be heat treated in a furnace atmosphere having an oxygen potential falling within the shaded area for a time sufficient to form or convert to the desired spinel on the stainless steel surface. The FIG. 1 graph is in the nature of an equilibrium diagram of the oxide surface on a stainless steel. However, it should be noted that rate phenomena also affect the mechanisms of this reaction. Rather than going into great detail in discussing the mechanisms and reactions we believe are involved, it should be sufficient to note that the bottom edge of the band is indeed the spinel equilibrium, i.e.

$$Fe + \tfrac{1}{2} O_2 + Cr_2O_3 \rightleftarrows FeCr_2O_4 \text{ (Spinel)} \quad (1)$$

This equilibrium can be stated mathematically as $$\log P_{O_2} = (-29{,}280/T) + 5.6 \quad (2)$$

where T is the absolute temperature in degrees Kelvin and $P_{O_2}$ is the parted pressure of oxygen. The top edge of the band, on the other hand, is the practical oxygen potential limit for spinel formation. Above this potential rate phenomena allow other competing reactions to form more complex oxides which are hard to remove from surface of stainless steels. This top line can be mathematically defined as:

$$\log P_{O_2} = (-27{,}840/T) + 8.1 \quad (3)$$

again where T is the absolute temperature in degrees Kelvin. Accordingly, yb heat treating a stainless steel within the shaded area or band, only the easily removed spinel is formed. Should the oxygen potential be such as to be above the band, as is typical of most stainless annealing atmospheres, the hard to remove surface films are also formed. Heat treating below the band, will of course cause the formation of $Cr_2O_3$ which is also thin, tightly adhering and hard to remove. The line at the bottom of the graph illustrates the oxygen potential necessary for the atmosphere to be reducing to stainless steel, i.e.

$$Cr_2O_3 \rightleftarrows 2\,Cr + 1\tfrac{1}{2}\,O_2 \quad (4)$$

Although one could conclude that annealing below this line would also yield beneficial results in eliminating all surface oxides, such would not be practical commercially as such low oxygen potentials could not be readily maintained with commercial facilities, and the holding time necessary to effect reduction even at higher temperatures would be unreasonably long. Then too, this would not yield a deep penetrating oxidation as is essential for some embodiments of this invention.

Although the broadest aspect of this invention contemplates any heat treatment of stainless steel wherein the furnace atmosphere is controlled to provide an oxygen potential within the shaded band of FIG. 1, i.e. wherein log $P_{O_2}$ is between $(-29{,}280/T) + 5.6$ and $(-27{,}840/T) + 8.1$, it is obvious that since the band represents equilibrium conditions, not all areas within the band are practical for commercial exploitation. For example, the desired spinel can indeed be formed at temperatures as low as 1500° F (1140° K) as shown in FIG. 1. Nevertheless, at such low temperatures the reactions to form spinel from the other surface oxides are exceedingly slow. For a reasonably reaction rate therefore the heat treating furnace temperature should be at least 1700° F but preferably higher, e.g. 1900°-2350° F, depending upon the objective sought for example, if it is desired to merely provide a more easily removable oxide film by pickling during say a 75 second continuous anneal on sheet, strip or wire, an ideal temperature would be 1900°-2200° F. On the other hand, where one is seeking to form a heavy scale so as to oxidize slivers, scabs, etc., on slabs, billets or rods, then the ideal temperature would be somewhat higher, e.g. 2250°-2350° F. In addition, the holding time should be extended, to at least about 10 minutes, but more ideally on the order of about 45 minutes. Obviously, of course, the temperature should not be over the liquation temperature of the particular steel being heat treated.

In addition to the above temperature considerations with reference to achieving a reasonably reaction rate, it should be noted that with increasing temperatures it becomes increasingly difficult to achieve and maintain lower oxygen potentials. Therefore, it is preferable to work with oxygen potentials just below the upper boundary of band and at higher temperatures because such atmospheres are more easily formed and maintained. In addition, in gas-fired furnaces where the combustion products comprise the furnace atmosphere, more efficiency can be realized by using higher oxygen potentials, i.e. by working closer to stoichiometric amounts of gas and air.

Figure 2:
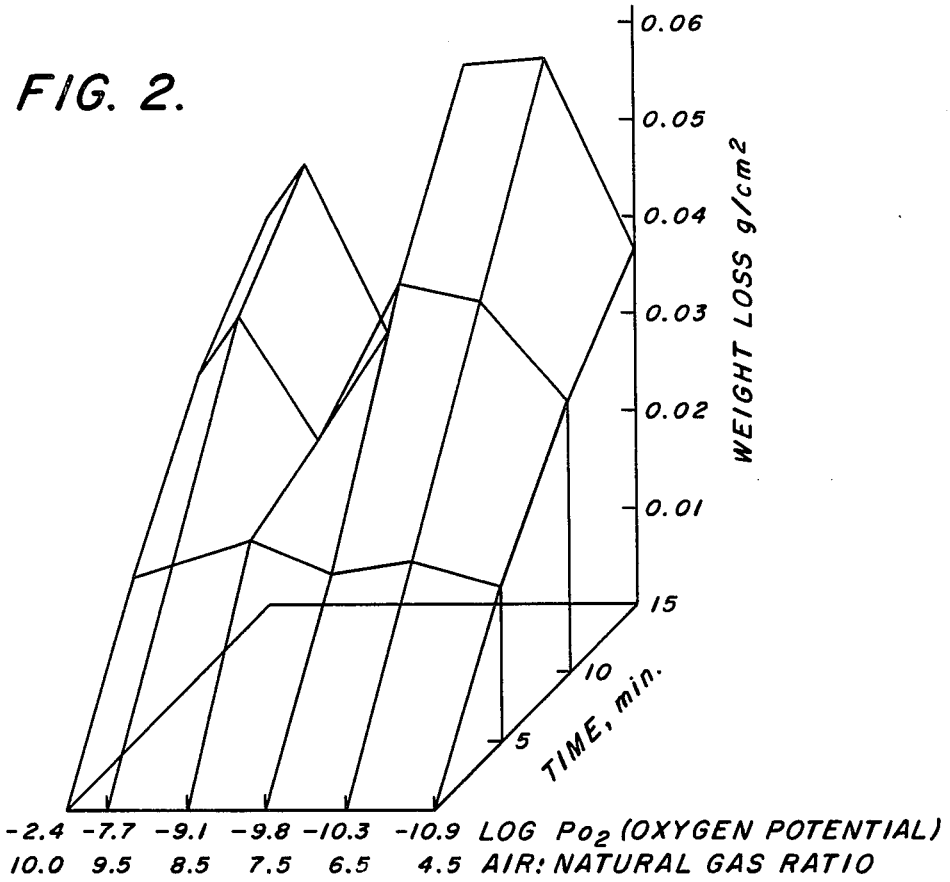
FIG. 2 is a three dimensional graph plotting the annealing atmosphere oxygen potential, an air-natural gas ratio, and time at 2330° F against the amount of scaling, i.e. weight loss of Type 304 stainless steel, thus illustrating the optimum parameters of the inventive process.

As already noted, the cubic iron-chromium spinel formed in the process of this invention, is quite different in nature from $Cr_2O_3$ and the usual rhombehedral outer layers of surface oxides formed on stainless steels. Whereas these oxide films are thin, impervious and protective, the spinel is less protective, and can therefore be formed with heavier thicknesses more quickly because it is more conductive electrically and ionically. Reference to FIG. 2 illustrates the spinel's more reactive nature by showng the loss of metal of different oxygen potentials during 15-minute anneals of an AISI Type 304 stainless steel at 2330° F (1550°K). At this temperature, the critical log $P_{O_2}$ is within the range $-9.8$ to $-10.3$. As can be seen in FIG. 2, the oxidation rate, i.e. weight loss, during the first 5 minutes of the anneal is substantially uniform for any oxygen potential. Beyond 5 minutes however, it can be seen that oxidation rates start to diminish for all oxide formations except the spinel, i.e. except when the log $P_{O_2}$ is between $-9.8$ and $-10.3$. That is to say, when the spinel is being formed, the oxidation rate after 15 minutes is approximately the same as after 5 minutes. On the other hand, when other oxide phases are being formed, the oxidation rate decreases more with time as such oxide formed provide greater protection of the underlying metal from further oxidation. Because of this characteristic of the oxidation of spinel, it is readily possible to increase the scaling of the surface of stainless steel slabs, billets, etc. to effectively oxidize and remove surface defects such as slivers and scabs.

It is apparent that the essential oxygen potential for the practice of this invention could be achieved by any one of a number of gas mixtures. For example, the $H_2O$—$H_2$—$O_2$ system, the $CO_2$—$CO$—$O_2$ system or a combination of these two systems as found in the combustion products when burning natural gas or other hydrocarbon fuels. In our development work, the heat for the anneal was achieved by burning natural gas in air. To achieve the essential oxygen potential at temperatures of from 1750 to 2330° F we found it necessary to provide an air to natural gas ratio of from 7.5:1 to 6.5:1. This ratio is deficient in oxygen from the stoichiometric ratio of about 9.7:1 as necessary for complete combustion of the natural gas. It should be understood that the composition of natural gas will vary somewhat in different regions of the country. Hence, the above critical range of 7.5:1 to 6.5:1 is applicable primarily to the natural gas as currently available in the Pittsburg, Pa. area, which has a composition as follows:

Methane ($CH_4$): 95.5%
Ethane ($C_2H_6$): 2.9%
Ethylene ($C_2H_4$): 0.18%
Butane ($C_4H_{10}$): 0.37%
Carbon Dioxide ($CO_2$): 0.97%
Inert Gases: Balance Accordingly, for natural gases of different composition, somewhat different ratios may be necessary. One way of experimentally determining a suitable ratio is to anneal the stainless steel for a few minutes in a natural gas to air combustion mixture wherein the amount of air is progressively reduced when a suitable ratio is achieved, the desired spinel is readily formed. This will be visually apparent as the oxide on the stainless steel turns black as the spinel is formed.

The following examples are presented to better illustrate the advantages of the invention.

In one series of tests, cold reduced Type 304 stainless steel was processed to demonstrate the ease of removal of the spinel by simple pickling. For this test, a sample of commercially processed, cold-rolled steel was obtained. Specimens 3 inches long by 1¼ inches wide (76.2 × 32mm) were sheared from the 0.065-inch thick (1.65mm) strip with the long axis parallel to the rolling direction. The specimens were ground to square the edges and remove burrs and sharp corners, and then were degreased and wiped clean.

Duplicate specimens of the cold-rolled strip were heated for 75 and 150 seconds at temperatures of 2060° and 2195° F (1400° and 1475° K) in atmospheres resulting from the combustion of natural gas in air at air to gas ratios of 10:1, 9:1, 8:1, 7.5:1 and 6:1. At 2060° F these ratios provided oxygen potentials of −0.3, −9.5, −10.4, −11.7 and −11.5 respectively. At 2195° F, these ratios provided oxygen potentials of −0.3, −10.6, −11.5, −11.8 and −12.5 respectively. The times and temperatures were chosen to bracket the known commercial parameters for this grade, i.e. 125 seconds at 2050° F (1395° to 1420° K) with an air to gas ratio greater than stoichiometric burning, i.e. 9.7:1.

The oxidized samples were pickled in 10% nitric acid at about 160° F (345° K) for 2 minutes.

Those specimens oxidized in air to gas ratios of 10:1 and 9:1 formed a tight oxide not readily removed by the nitric acid pickle. The oxides formed in the first 75 seconds at the lower air to gas ratios of 8:1 to 9:1 were also difficult to remove because not all of the surface oxide was spinel. However, at air to gas ratios of 8:1 to 6.5:1 and holding times of 150 seconds, the black oxide was easily and completely removed during the first nitric acid treatment, especially those oxides formed at air to gas ratios of 7.5:1 to 6.5:1. At 2195° F, a tight oxide, resistant to nitric acid formed in 75 seconds at air to gas ratios of 10:1 and 9:1. Decreasing the air to gas ratio to 7.5:1 made it possible to remove all the oxide formed in 75 seconds. About half of the oxide formed in 150 seconds at 10:1 could be removed with nitric acid, whereas most, but not all, the oxide formed in 150 seconds at a ratio of 9:1 could be removed by nitric acid. In addition, the specular gloss of the pickled steel was reduced by a factor of at least four when the gas ratio was lowered from 10:1 to 7.5:1. This provides a smooth, non-glare surface.

It was apparent that the oxide that first formed under any conditions was the tight, $Cr_2O_3$ film that is impervious to the nitric acid solution. At air to gas ratios of 10:1 to 9:1, and by increasing the temperature and/or extending the holding time, this phase thickens slightly and cracks and can at least partially be removed by the nitric acid. However, at air to gas ratios of 7.5:1 to 6.5:1 the $Cr_2O_3$ transforms to spinel which is much more easily removed by the nitric acid.

Figure 3:
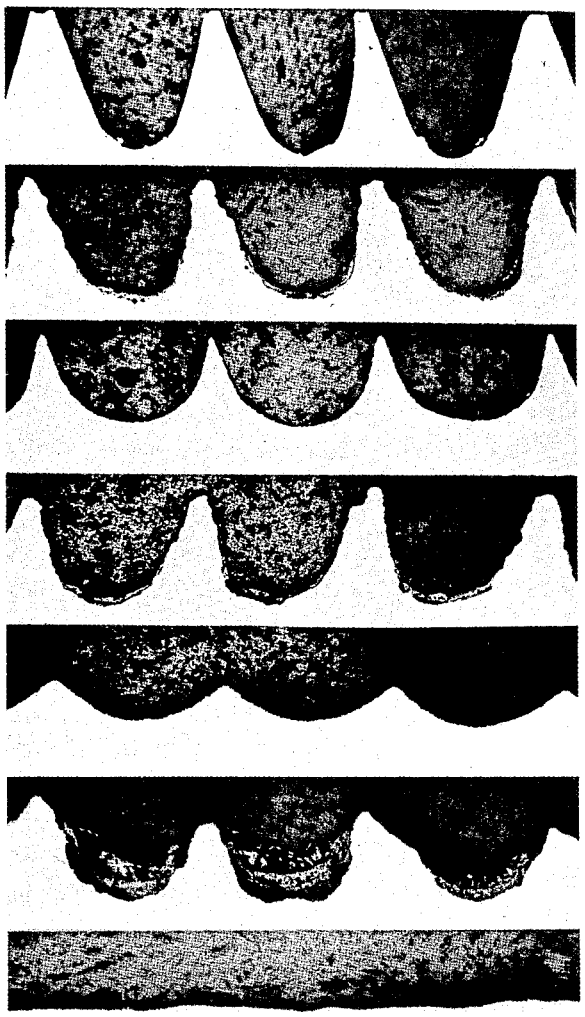
FIG. 3 is a number of photomicrographs, at 25× magnification showing sections through the surface of a Type 304 stainless steel after various annealing treatments.

Another series of tests were conducted to examine the smoothening effect of the inventive process. For this test, a piece of hot rolled, annealed and pickled Type 304 stainless-steel strip 0.133 inch thick (3.38 mm) was serrated on a milling machine to produce 0.040-inch deep (1.02 mm) grooves. The machined piece of steel was then cut into samples 2 inches long by 1¼ inches wide (50.8 × 32 mm). The serrations were utilized to simulate a very rough surface consisting of a pattern of peaks and valleys similar to a rough-ground surface or shallow defects. The effect of furnace atmosphere on smoothing these peaks was determined by oxidizing treatments with air to natural gas ratios varying from 10:1 to 6.5:1. The samples were heated at 2250° and 2330° F for 45, 90 and 180 minutes and then pickled in 10% nitric acid at 160° F to remove only oxide and not metal. Photomicrographs were then taken of the sample sections. The results of this test are shown in FIG. 3 for those samples heated to 2330° F. With reference to FIG. 3, the top photo shows the grooves as machined, while the bottom photo shows the remarkable effect of the 6.5:1 air to gas ratio for 180 minutes. It can be seen that the peaks were completely removed under these annealing conditions. Contrasting the bottom photo with the next above photo wherein a 10:1 air to gas ratio was used will clearly illustrate the advantage of the lower ratio. Those samples heated to 2250° F shows similar results although not quite so dramatic. Nevertheless, with somewhat extended holding times, the results should have been equally dramatic.

In addition to the above tests, numerous other tests were conducted, not only on AISI Type 304 stainless steels, but also on AISI Types 430, 409 and on a patented grade known as 18-18-2 (U.S. Pat. No. 3,523,788). All these tests verified the above teaching.

In view of the foregoing description it is readily apparent that the process disclosed could have several varied applications. For example, the process of this invention could be incorporated into a stainless steel continuous annealing line whereby the spinel is formed while the sheet is being continuously annealed, thereby providing an oxide film which can be more easily or quickly removed to facilitate further processing. On the other hand, the process may be incorporated into a slab or billet reheating facility or a hot rolled strip annealing facility to scale the surface to oxidize slivers, scabs and other surface defects which can thereafter be readily removed prior to further hot or cold rolling. In addition, the process of this invention can be applied to finished stainless steel products to remove mill-scale and enhance its appearance. As noted above, it can be used to smoothen a rough machined stainless steel surface, or provide a smooth non-glare satin finish. Indeed, the process can be incorporated into any stainless steel production sequence wherein it is desired to remove surface oxides, and/or remove surface defects, and/or smoothen the surface.

We claim:

1. A method of surface conditioning a stainless steel containing at least about 11 percent chromium to form an oxide layer thereon which can easily be removed by conventional pickling, comprising heating said steel to a temperature of at least 1700° F, but below the liquation temperature of the steel, in an atmosphere having an oxygen potential such that the log of the oxygen partial pressure is within the range $(-29{,}280/T) + 5.6$ to $(-27{,}840/T) + 8.1$, where T is the absolute temperature in degrees Kelvin, for a time sufficient to form a surface oxide thereon consisting primarily of the spinel, $FeCr_2O_4$, cooling said steel, and pickling the cooled steel in a conventional carbon steel acid pickling solution for a time sufficient to remove said spinel.

2. A method according to claim 1 in which said temperature is within the range 1900° to 2350° F.

3. A method according to claim 1 in which a thin oxide layer is formed by heating the steel at a temperature of 1900° to 2200° F for a period of at least 75 seconds.

4. A method according to claim 3 in which said steel is in sheet form and said heating is effected during a continuous anneal.

5. A method according to claim 3 in which said steel is in strip form and said heating is effected during a continuous anneal.

6. A method according to claim 3 in which said steel is in wire form and said heating is effected during a continuous anneal.

7. A method according to claim 1 in which a thick oxide layer is formed by heating the steel at a temperature of 2250° to 2350° F for a period of a least 10 minutes.

8. A method according to claim 7 in which said steel is in slab form and said heating is effected during a preheating treatment.

9. A method according to claim 8 in which said oxide layer is sufficiently thick to oxide all slivers, scabs and other surface defects.

10. A method according to claim 7 in which said steel is in billet form and said heating is effected during a preheating treatment.

11. A method according to claim 10 in which said oxide layer is sufficiently thick to oxide all slivers, scabs and other surface defects.

12. A method according to claim 7 in which said steel is in rod form and said heating is effected during a preheating treatment.

13. A method according to claim 12 in which said oxide layer is sufficiently thick to oxide all slivers, scabs and other surface defects.

14. A method according to claim 1 further including the step of removing said surface oxide by pickling said steel in a dilute acid solution.

15. A method according to claim 14 in which said acid solution is a dilute $HNO_3$ solution.

16. A method according to claim 14 in which said steel is pickled at a faster rate in a conventional electrolytic $H_2SO_4$ solution followed by pickling in a conventional $HNO_3$-HF solution.

17. A method according to claim 1 in which said oxygen potential is provided by utilizing the combustion products from burning natural gas in air at an air to gas ratio of from 7.5:1 to 6.5:1.

* * * * *